US010118789B2

(12) United States Patent
Calman et al.

(10) Patent No.: US 10,118,789 B2
(45) Date of Patent: Nov. 6, 2018

(54) TAPE PRODUCT DISPENSER AND METHOD OF USING A TAPE PRODUCT DISPENSER

(71) Applicant: Geek Wraps, Inc., Oakland Park, FL (US)

(72) Inventors: Kenneth J. Calman, Oakland Park, FL (US); Kathryn S. Calman, Oakland Park, FL (US)

(73) Assignee: Geek Wraps, Inc., Oakland Park, FL (US)

( * ) Notice: Subject to any disclaimer, the term of this patent is extended or adjusted under 35 U.S.C. 154(b) by 514 days.

(21) Appl. No.: 14/657,863

(22) Filed: Mar. 13, 2015

(65) Prior Publication Data

US 2015/0266691 A1 Sep. 24, 2015

Related U.S. Application Data

(63) Continuation-in-part of application No. 13/875,798, filed on May 2, 2013.

(60) Provisional application No. 61/689,070, filed on May 29, 2012.

(51) Int. Cl.

| | |
|---|---|
| ***B65H 35/00*** | (2006.01) |
| ***B65H 75/14*** | (2006.01) |
| ***B65H 16/00*** | (2006.01) |
| ***B65H 49/20*** | (2006.01) |
| ***B65H 75/30*** | (2006.01) |
| ***B65H 75/32*** | (2006.01) |

(52) U.S. Cl.

CPC ..... *B65H 35/0033* (2013.01); *B65H 16/005* (2013.01); *B65H 49/205* (2013.01); *B65H 75/305* (2013.01); *B65H 75/32* (2013.01); *B65H 2701/377* (2013.01)

(58) Field of Classification Search

CPC .. B65H 35/0033; B65H 75/32; B65H 75/305; B65H 49/205; B65H 16/005; B65H 2701/377

See application file for complete search history.

(56) References Cited

U.S. PATENT DOCUMENTS

| | | | | | |
|---|---|---|---|---|---|
| 2,908,132 | A * | 10/1959 | Klemm | B65H 49/205 | 140/123 |
| 3,138,512 | A * | 6/1964 | Partin | E04F 21/1657 | 156/461 |
| 3,942,736 | A * | 3/1976 | Ramos | B65H 49/32 | 242/423.1 |
| 3,944,161 | A * | 3/1976 | Kauf | B65H 49/205 | 111/199 |
| 4,852,822 | A * | 8/1989 | Brady | B65H 75/406 | 242/405.3 |
| 7,201,201 | B2 * | 4/2007 | Grenier | B44D 3/00 | 156/527 |
| 2007/0267148 | A1 * | 11/2007 | Steele | B65H 35/0026 | 156/577 |

(Continued)

*Primary Examiner* — William A. Rivera

(74) *Attorney, Agent, or Firm* — Ice Miller LLP

(57) ABSTRACT

A tape product dispenser and method of using a tape product dispenser are provided. The tape product dispenser includes a reel member comprising an internal loading surface for loading a tape product and a housing. The housing comprises a lower portion and a housing port disposed at a radially outer end of the housing. The lower portion is coupled to the reel member for rotation of the reel member relative to the lower portion.

16 Claims, 8 Drawing Sheets

(56) References Cited

U.S. PATENT DOCUMENTS

2015/0298935 A1* 10/2015 Langeman ..... B65H 49/327
242/588

* cited by examiner

TAPE PRODUCT DISPENSER AND METHOD OF USING A TAPE PRODUCT DISPENSER

RELATED APPLICATION DATA

This application is a continuation application of U.S. application Ser. No. 13/875,798, filed May 2, 2013, which is hereby incorporated in its entirety herein by reference.

FIELD OF THE INVENTION

The present invention relates to tape product dispensers and methods of using tape product dispensers.

BACKGROUND OF THE INVENTION

Tape products may include knife tape, thin paint tape, and edge cut tape products that are used for many different purposes. Knife tape and edge cut tape products may be used when applying graphics for advertising or otherwise displaying graphics on signs, automobiles, buildings, and numerous other surfaces. Additionally, vehicle painters, pinstripe installers, and graphics installers use tape products such as thin paint tape and knife tape to precisely apply complicated paint and vinyl graphic designs.

Tape products are typically supplied on a bulk roll. The user must simultaneously unroll and handle the bulk roll while attempting to apply the tape product to a work surface in a desired pattern. However, many applications of tape products require the tape product to be applied using extensive artistic and utilitarian design techniques. Some of these design techniques include the use of curves, swirls, perfectly straight lines, changes in tape direction, including complete reversals of direction over a very tight radius turn, and placement over uneven surfaces, convex and concave curves, overlapping seams, and onto difficult areas to access. Handling of the cumbersome bulk tape roll often hinders the creation and application of these complicated paint, graphic, or other patterns.

Therefore, there remains a need for a tape product dispenser that reduces the handling requirements of the user as the tape product is applied to a work surface. Additionally, a tape product dispenser that can be quickly and securely loaded with a bulk tape product roll is desirable.

SUMMARY OF THE INVENTION

In accordance with an aspect of the invention, a tape product dispenser is provided comprising a reel member comprising an internal loading surface for loading a tape product and a housing comprising a lower portion and a housing port disposed at a radially outer end of the housing. The lower portion is coupled to the reel member for rotation of the reel member relative to the lower portion.

In accordance with further aspects of the invention, a method of using a tape product dispenser includes providing a reel member comprising an internal loading surface, providing a housing comprising a lower portion and a housing port, placing a tape product spool having a tape product on the internal loading surface, rotating the reel member such that a portion of the tape product extends from the tape product spool in a radially outward direction toward the housing port, and contacting the housing port with the tape product.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

In a preferred embodiment of the present invention, a tape product dispenser is provided to dispense tape products including, but not limited to, knife tape products, thin paint tape products, and edge cut tape products for use by individuals such as vinyl graphic installers, vehicle wrap installers, vehicle painters, vehicle pinstripe artists, and sign painters or designers. The present invention aids in the application of a variety of tape products to various surfaces such as vehicles, indoor substrates, and outdoor substrates.

Figure 1:
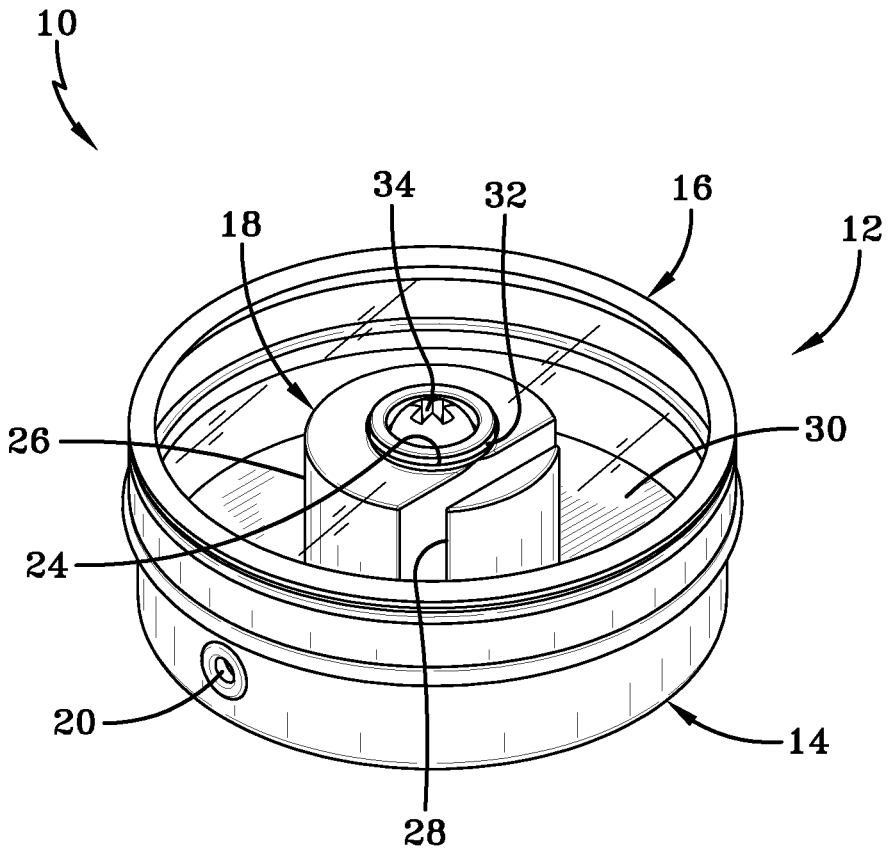
FIG. 1 is a perspective view of a tape product dispenser according to aspects of the present invention.

Reference is now made to FIG. 1, which shows a tape product dispenser 10 according to aspects of the present invention. The dispenser 10 is shown having a housing 12 comprising a lower portion 14 and an upper portion 16. The upper portion 16 is configured to be opened to permit access to a reel member 18. In the preferred embodiment, the housing 12 is in the shape of a cylinder with the upper portion 16 of the housing 12 being a transparent lid. When the upper portion 16 is closed, a transparent lid allows observation of the rotation of the reel member 18 to confirm proper loading of tape product while also providing an indication of the amount of tape product on the reel member 18. A housing port 20 is shown on the lower portion 14 of the housing 12 in the preferred embodiment of FIG. 1. The housing port 20 enables dispensing of a tape product from an interior of the housing 12. Additionally, the housing port 20 enables loading of a tape product from outside of the housing 12 as will be further explained below. As shown in FIG. 1, the upper portion 16 includes a central opening 24 to allow access to, and rotation of, the reel member 18 from outside of the housing 12 when the dispenser 10 is assembled as shown in FIG. 1.

Figure 2:
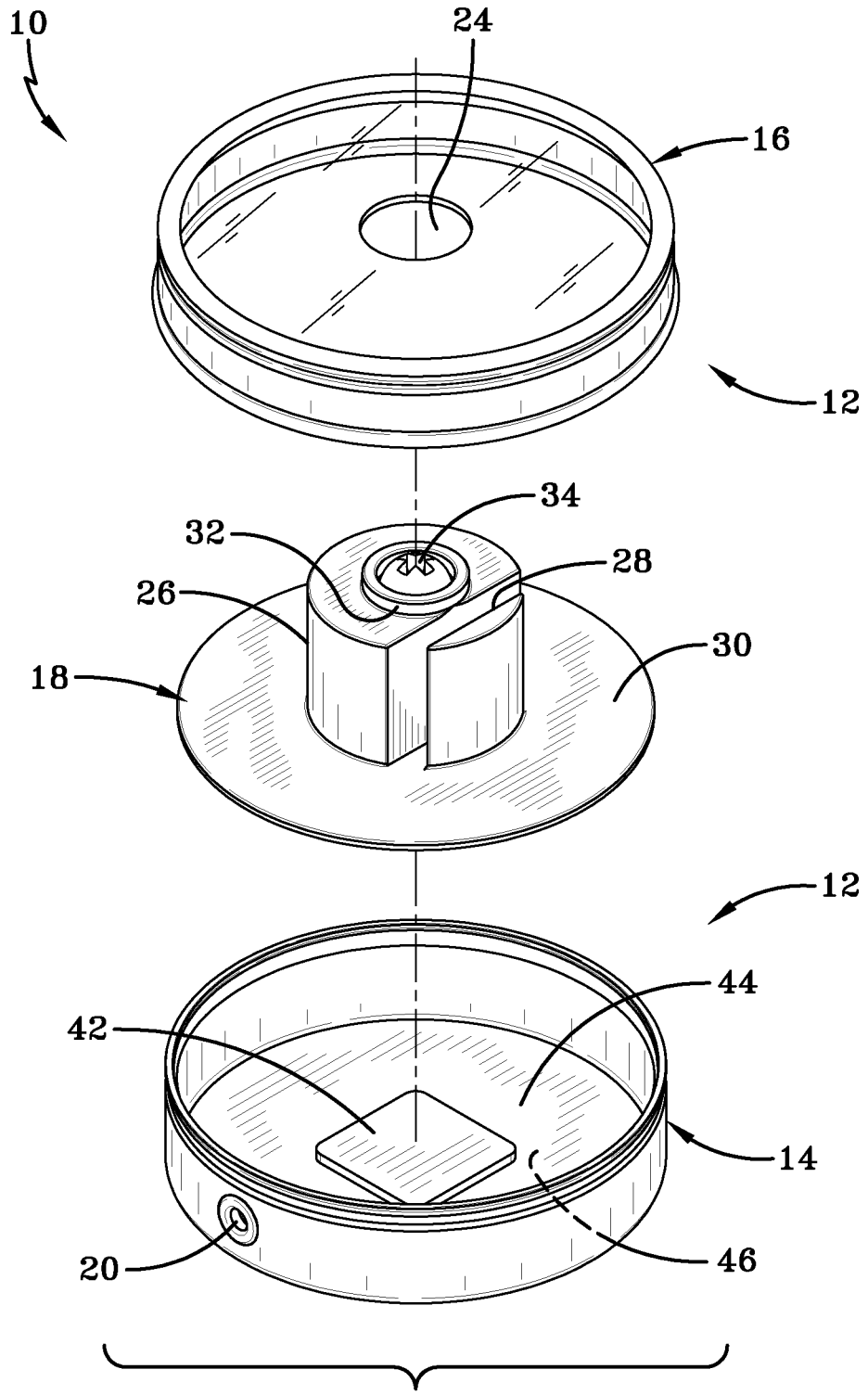
FIG. 2 is an exploded perspective view of a tape product dispenser according to aspects of the present invention.

Referring now to FIG. 2, the exploded view of FIG. 2 shows the lower portion 14 and the upper portion 16 of the dispenser 10 cooperating to at least partially enclose the reel member 18. The reel member 18 includes an internal loading surface 26 onto which a tape product is loaded when the reel member 18 is rotated. The reel member 18 of the preferred embodiment shown in FIG. 2 additionally includes a loading cavity 28 adjacent to the internal loading surface 26. When a tape product is initially loaded onto the internal loading surface 26, an end portion of the tape product is placed through the housing port 20 before the end portion of the tape product is placed on a surface of the loading cavity 28 to enable loading of the tape product onto the internal loading surface 26 through rotation of the reel member 18. The central opening 24 allows the reel member 18 to be rotated with the upper portion 16 of the housing 12 connected with the lower portion 14 to at least partially enclose the reel member 18. However, reel member 18 may also be rotated with the upper portion 16 removed from the lower portion 14. FIG. 2 illustrates the loading cavity 28 as a slot that extends through a central cylinder of the reel member 18. However, the loading cavity 28 may include any surface or cavity designed to initiate loading of the tape product onto the reel member 18 prior to or during rotation of the reel member 18.

FIG. 2 additionally illustrates a loading flange 30 extending radially outward from the internal loading surface 26. The loading flange 30 is disposed adjacent to the lower portion 14 of the housing 12 when the dispenser 10 is assembled as shown in the preferred embodiment of FIG. 1. During loading and dispensing, the loading flange 30 cooperates with the internal loading surface 26 to load and support a tape product on the internal loading surface 26.

Additionally, FIGS. 1 and 2 of the present invention illustrate a central portion 32 of the reel member 18. Central portion 32 is also referred to herein as a central protrusion 32. In the preferred embodiment of the present invention, central protrusion 32 is intended to protrude into the central opening 24 of the upper portion 16 of the housing 12 when the dispenser is assembled as shown in FIG. 1. The central protrusion 32, loading flange 30, internal loading surface 26, and loading cavity 28 of the reel member 18 are all integrally connected to each other as one machined polymeric piece in the preferred embodiment. However, these integral portions of the reel member 18 may be separately formed and coupled together into a reel member assembly. Additionally, any portion of the reel member 18 may be formed by other manufacturing processes, such as molding, and may be comprised of another material such as wood, metal, composite, or combinations thereof.

The central protrusion 32 and the central opening 24 of the upper portion 16 of the housing 12, as shown in FIGS. 1 and 2, cooperate to allow the reel member 18 to be accessed from outside of the housing 12 such that the reel member 18 may be rotated with the upper portion 16 of the housing 12 closed. FIG. 2 shows the central protrusion 32 of the preferred embodiment including a central indentation 34 to enable engagement with a tool to allow rotation of the reel member 18.

Figure 3:
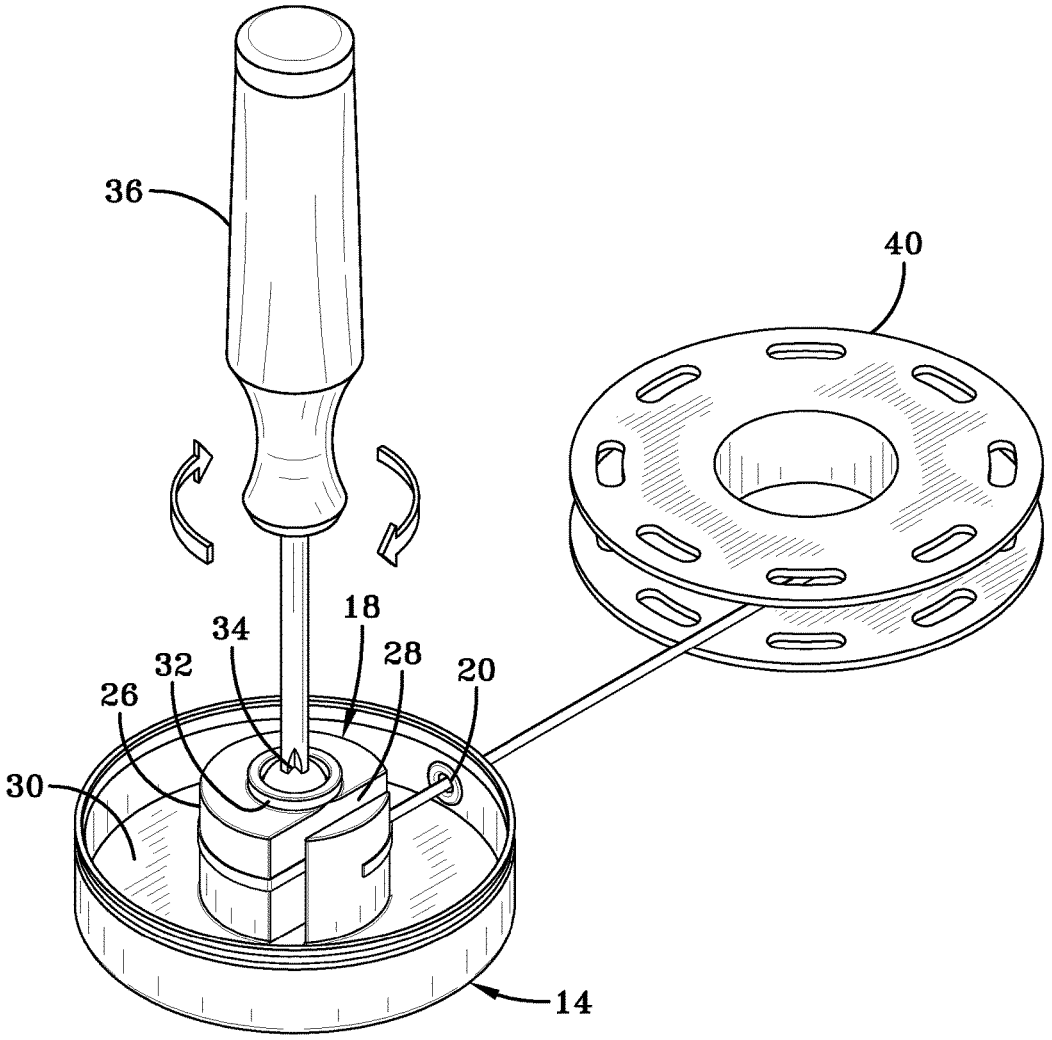
FIG. 3 is a perspective view of a tape product dispenser and one embodiment of engagement of the tape product dispenser according to aspects of the present invention.
Figure 4:
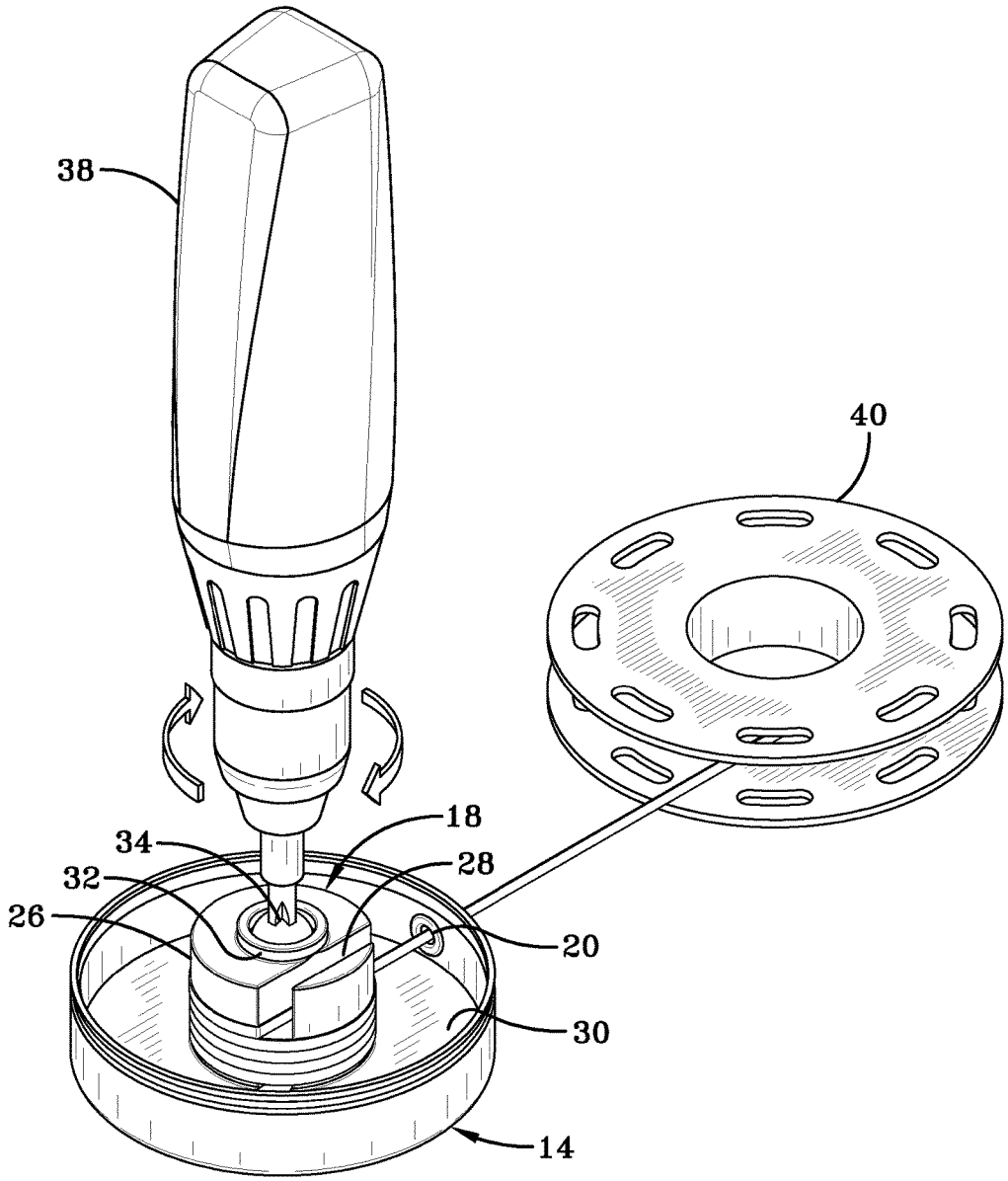
FIG. 4 is a perspective view of a tape product dispenser and another embodiment of engagement of the tape product dispenser according to aspects of the present invention.

Additionally, FIGS. 3 and 4 further illustrate the central indentation 34 of the preferred embodiment being configured to engage a tool such as a screwdriver 36, screw gun 38, or drill 38 to enable rotation of the reel member 18 from outside of the housing 12 when the upper portion 16 is closed. As shown in FIGS. 3 and 4, the dispenser 10 is quickly and securely loaded with tape product from a bulk roll or spool 40 with the use of a screwdriver 36, screw gun 38, or drill 38 to rotate the reel member 18. In place of a tool engaging the reel member 18, the reel member 18 of the present invention may include a crank or similar device (not shown) integrally formed with, or coupled to, the reel member 18 to rotate the reel member 18 from outside of the housing 12. Further, the crank or similar device may be removable or releasably attached to the reel member 18.

Figure 5:
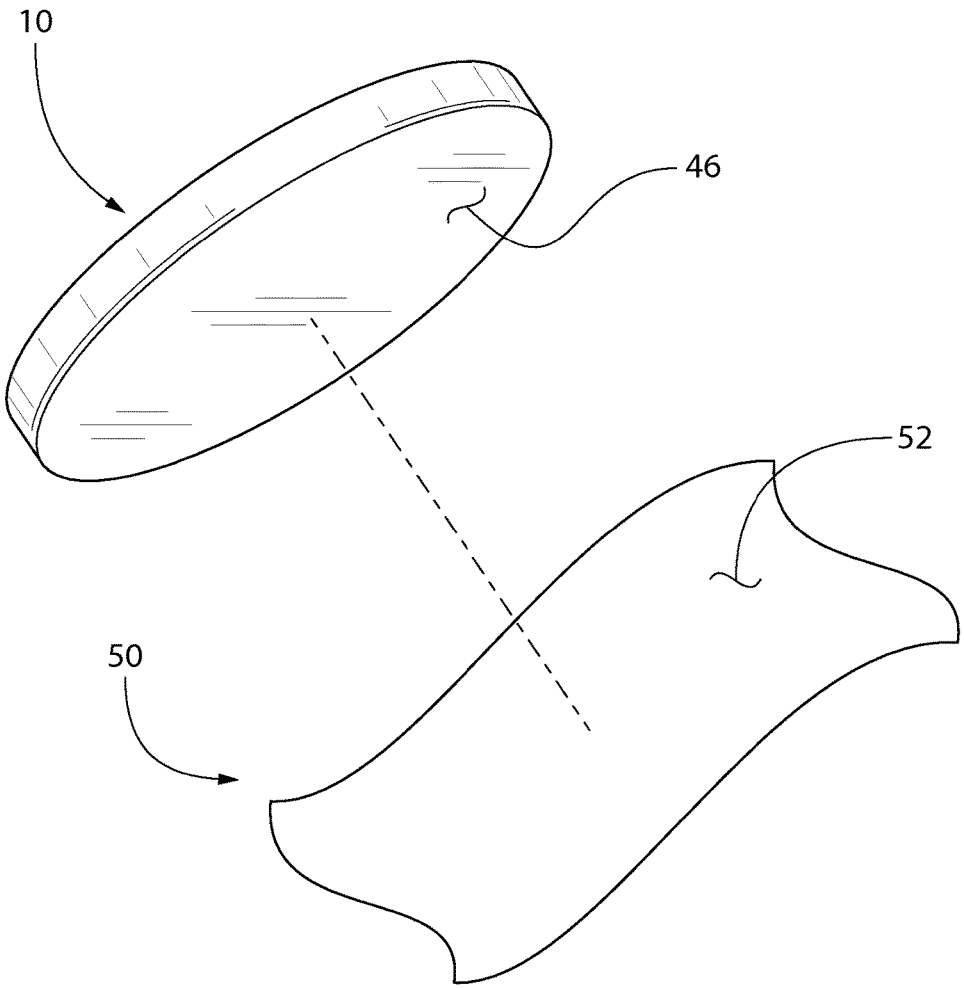
FIG. 5 is a perspective view of a tape product dispenser and mounting surface according to aspects of the present invention.

Referring again to the preferred embodiment of FIG. 2, the lower portion 14 of housing 12 comprises a magnetic member 42. The magnetic member 42 of the preferred embodiment is a thin rare earth magnet that is fastened to an inside surface 44 of the lower portion 14 of the housing 12. As illustrated in FIG. 5, the magnetic member 42 is configured to allow magnetic coupling of the housing 12 to a mounting surface 52, such as a metallic or magnetic vehicle panel, wrist band, vest, or jacket, represented generally in FIG. 5 at 50. The outside surface 46 of the lower portion 14 of the housing 12 comprises a low friction material configured to minimize damage to the mounting surface 52 due to contact with the lower portion 14 at the outer surface 46. In the preferred embodiment, the outer surface 46 of the lower portion 14 includes a fiberglass tape covering, as shown generally in FIG. 5. Additionally, an outer surface of the reel member 18 may also include a low friction material, such as a fiberglass tape covering, in order to reduce rotational resistance due to friction between the reel member 18 and the inside surfaces of the housing 12. In place of, or in addition to, the magnetic member 42, other fastening devices may be utilized to couple the housing 12 to a mounting surface. Such fastening devices may include hook and loop fasteners, adhesives, or mechanical fasteners.

Figure 6:
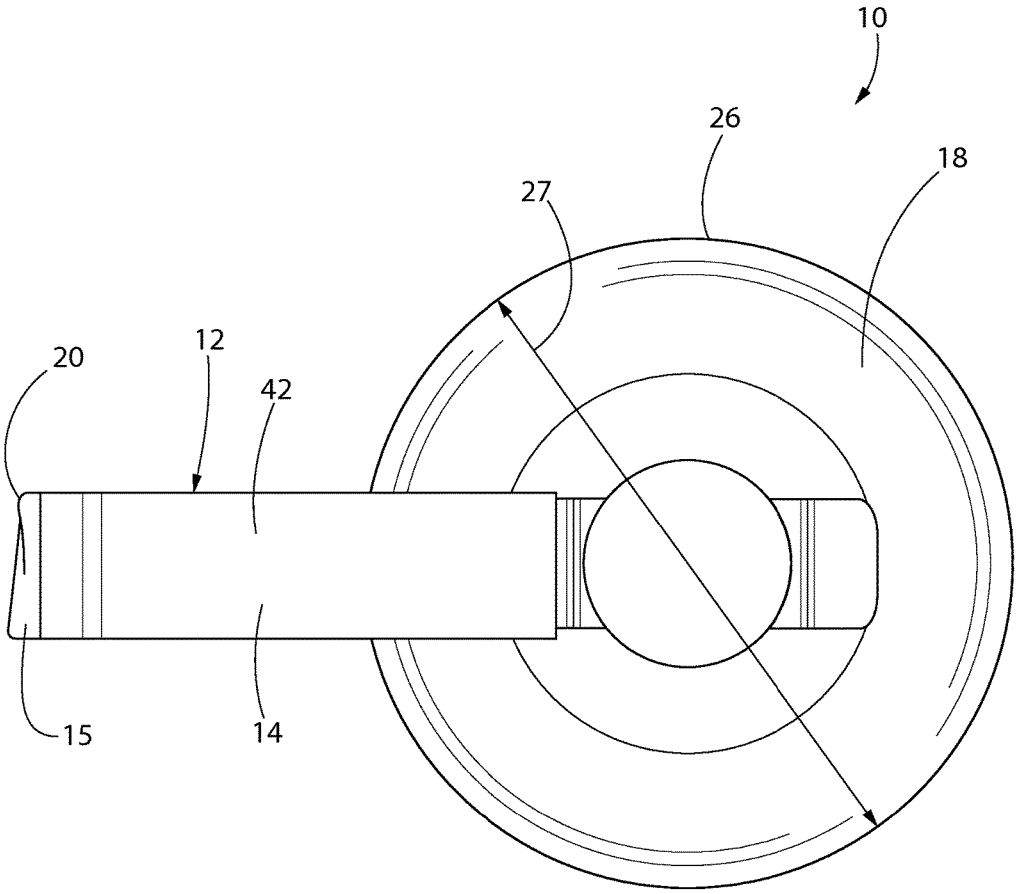
FIG. 6 is a bottom plan view of a tape product dispenser according to aspects of the present invention.
Figure 7:
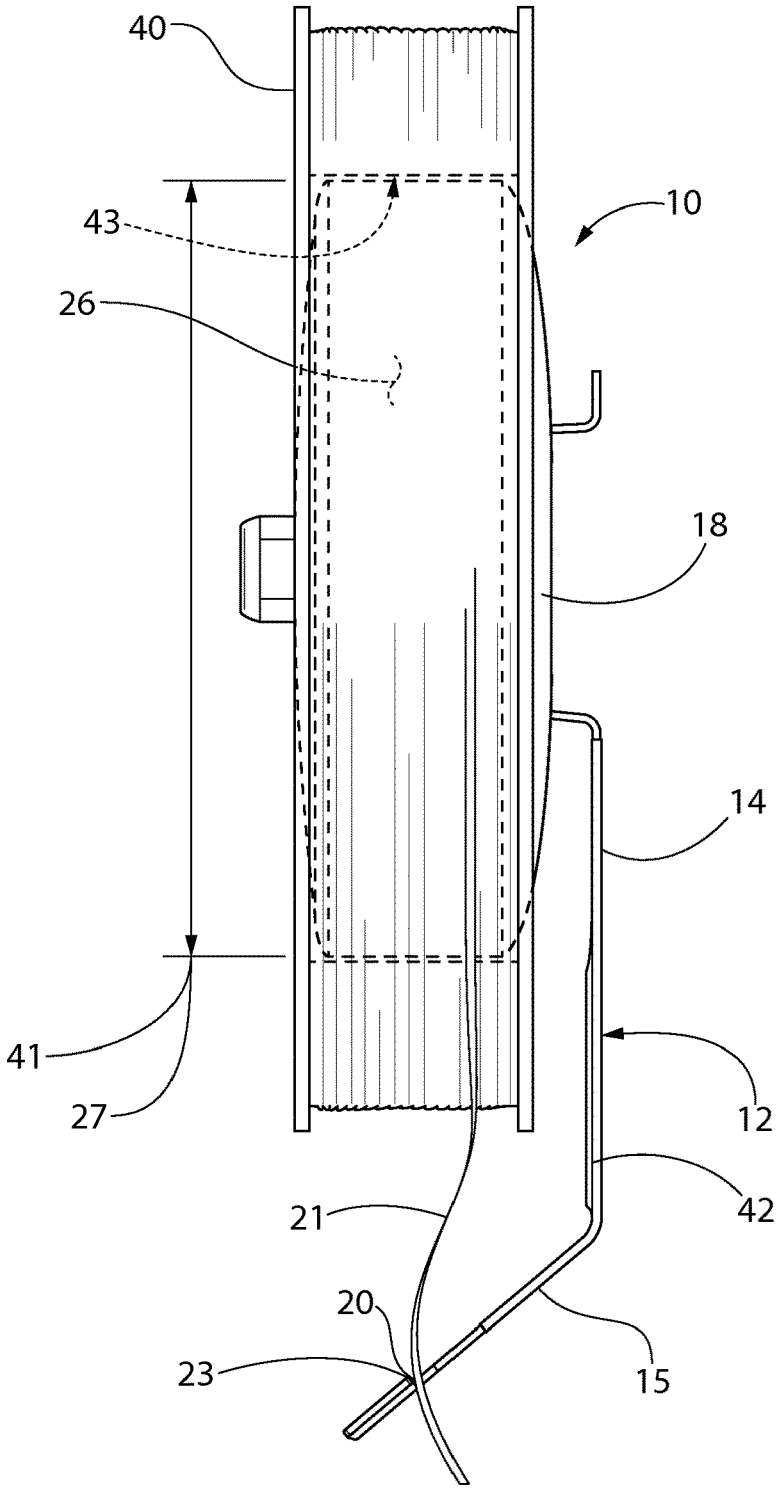
FIG. 7 is a side elevation view of a tape product dispenser according to aspects of the present invention.
Figure 8:
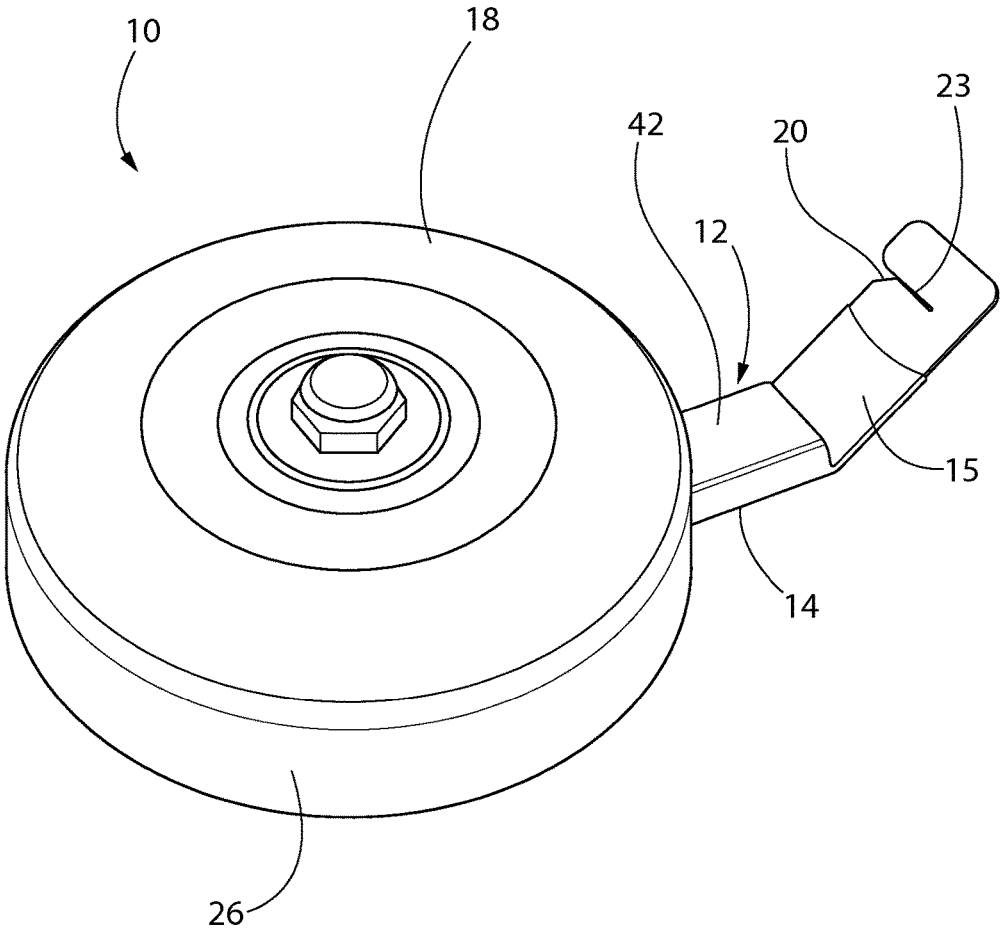
FIG. 8 is a perspective view of a tape product dispenser according to aspects of the present invention.

Referring now to FIGS. 6-8, an embodiment of the tape product dispenser 10 is illustrated in accordance with aspects of the present invention. The dispenser 10 is shown having a housing 12 comprising a lower portion 14 and a termination portion 15. In an embodiment, the lower portion 14 extends radially outward and the termination portion 15 extends axially from the lower portion 14 relative to the axis of the reel member 18. As illustrated in the embodiment of FIG. 7, the termination portion 15 extends both axially and radially. The termination portion 15 may extend only in an axial direction and may include any degree of radial extension. In order to enhance visibility of, and access to, a reel member 18, no upper portion is included in the embodiment shown in FIGS. 6-8. A housing port 20 is shown on the lower portion 14 of the housing 12 at the termination portion 15. The housing port 20 in an embodiment includes a notch to guide tape product 21 during dispensing. In a further embodiment, the housing port 20 includes a cutting edge 23 configured to cut the tape product 21 at a desired point, as illustrated in FIG. 7.

The reel member 18 includes an internal loading surface 26 for loading a tape product spool 40. The tape product may be loaded onto the internal loading surface 26 with or without the tape product spool 40 being loaded onto the spool 40. The lower portion 14 is coupled to the reel member 18 to allow rotation of the reel member 18 relative to the lower portion 14. In the embodiment illustrated in FIGS. 6-8, the internal loading surface 26 defines a reel outer diameter 27 substantially equal to a spool inner diameter 41 of a tape product spool 40. In such an embodiment, an inner surface 43 of the tape product spool 40 is positioned against the reel outer diameter 27. The reel member 18 illustrated in FIG. 2 may include a diameter equal to the reel outer diameter 27 illustrated in FIG. 6. Similarly, the reel member 18 of either FIG. 2 or 6 may include a diameter sized to match any spool or bulk roll or any other desired diameter.

In a further embodiment, the tape product dispenser of FIGS. 6-8 includes a magnetic member 42 disposed in or adjacent to the housing 12. The magnetic member 42 is configured to allow magnetic coupling of the housing 12 to the mounting surface 52, as discussed with regard to the embodiment illustrated in FIG. 1. The mounting surface 52 includes any application surface, work surface, or user surface, as discussed in further detail below. The magnetic member 42 is disposed adjacent the lower portion 14 to allow detachable coupling to the mounting surface 52.

In one or more embodiments, the lower portion 14 may extend to multiple sides of the reel member 18. As a non-limiting example, the housing 12 includes the lower portion 14 extending radially outward from the reel member 18 in two diametrically opposed directions. In an additional non-limiting example, the housing 12 includes the lower portion 14 extending radially outward from the reel member 18 in four directions, such as at 90 degree intervals. Further, the housing 12 may extend underneath the entire reel member 18 or fully surround the reel member 18 in an embodiment, similar to the structure of the lower portion 14 of FIGS. 1-5.

Upon dispensing, the tape product is pulled from the dispenser 10, such as through the housing port 20 or by merely rotating the reel member 18 while pulling the tape product. The relatively open housing 12 of FIGS. 6-8 allows dispensing of the tape product without rotation of the reel member 18, such as by merely pulling the tape product in an axial direction away from the dispenser 10. In order to increase dexterity for the user, the lower portion 14 may be magnetically attached to a metallic surface or a user surface, such as the mounting surface 52 illustrated in FIG. 5, including a vehicle, wrist band, waist, tool pouch, vest, or jacket surface, as the tape product is pulled and applied to a surface, such as an application surface or the mounting surface 52. Once attached to the mounting surface 52, the user has complete two-handed access to the tape product so that the tape may be placed onto a work or application surface for unlimited artistic and utilitarian design, including the use of curves, swirls, perfectly straight lines, complete changes in tape direction, and placement over convex and concave curves, overlapping seams, and onto difficult areas to access.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A tape product dispenser, comprising:

a reel member comprising an internal loading surface for loading a tape product; and a housing, comprising:

a lower portion; and a housing port disposed at a radially outer end of the housing, wherein the lower portion is coupled to the reel member for rotation of the reel member relative to the lower portion, wherein the housing includes an axially extending termination portion, the housing port being disposed at the termination portion, and wherein the housing port includes a notch configured to guide the tape product during dispensing of the tape product and a cutting edge configured to cut the tape product at a desired point.

2. The tape product dispenser of claim 1, wherein the internal loading surface defines a reel outer diameter substantially equal to a spool inner diameter of a tape product spool.

3. The tape product dispenser of claim 1, further comprising a tape product spool having an inner surface defining a spool inner diameter, wherein the internal loading surface defines a reel outer diameter, the inner surface of the tape product spool positioned against the reel outer diameter.

4. The tape product dispenser of claim 1, wherein the lower portion extends radially to the termination portion.

5. The tape product dispenser of claim 1, further comprising a tape product spool having an inner surface defining a spool inner diameter, wherein the internal loading surface defines a reel outer diameter, the inner surface of the tape product spool positioned against the reel outer diameter.

6. The tape product dispenser of claim 1, wherein the housing comprises a magnetic member configured to allow magnetic coupling of the housing to a mounting surface.

7. The tape product dispenser of claim 6, wherein the magnetic member is disposed adjacent the lower portion.

8. A method of using a tape product dispenser, comprising:

providing a reel member comprising an internal loading surface;

providing a housing comprising:

a lower portion; and a housing port including a notch configured to guide a tape product during dispensing of the tape product;

placing a tape product spool having a tape product on the internal loading surface;

rotating the reel member such that a portion of the tape product extends from the tape product spool in a radially outward direction toward the housing port; and contacting the housing port with the tape product, wherein contacting the housing port with the tape product includes cutting the tape product at the housing port.

9. The method of claim 8, further comprising:

providing a magnetic member adjacent the lower portion; and coupling the housing to a mounting surface with the magnetic member.

10. The method of claim 9, wherein the mounting surface includes a vehicle surface.

11. The method of claim 9, wherein the mounting surface includes a user surface.

12. The method of claim 11, wherein the user surface includes one of a wristband, belt, tool pouch, vest, and jacket surface.

13. The method of claim 8, wherein the internal loading surface comprises an outer diameter substantially equal to an inner diameter of a tape product spool.

14. The method of claim 8, wherein the housing includes an axially extending termination portion, the housing port being disposed at the termination portion.

15. The method of claim 14, wherein the lower portion extends radially to the termination portion.

16. A tape product dispenser, comprising:

a reel member comprising an internal loading surface for loading a tape product; and a housing, comprising:

a lower portion without an upper portion extending between the reel member and a termination portion of the housing, the termination portion extending both axially and radially;

a housing port disposed at a radially outer end of the housing; and a magnetic member disposed at the lower portion of the housing and configured to allow magnetic coupling of the housing to a mounting surface;

wherein the lower portion is coupled to the reel member for rotation of the reel member relative to the lower portion, wherein the housing port is disposed at the termination portion, and wherein the housing port includes a notch configured to guide the tape product during dispensing of the tape product and a cutting edge configured to cut a tape product at a desired point.

* * * * *